US006047646A

United States Patent [19]

Gugel

[11] Patent Number: 6,047,646

[45] Date of Patent: Apr. 11, 2000

[54] ASSEMBLABLE DISPLAY UNIT WITH INTEGRATED PALLET

[75] Inventor: Richard R. Gugel, Middletown, Ohio

[73] Assignee: Tenneco Packaging Inc., Evanston, Ill.

[21] Appl. No.: 08/941,834

[22] Filed: Oct. 1, 1997

Related U.S. Application Data

[63] Continuation of application No. 08/636,975, Apr. 24, 1996, abandoned.

[51] Int. Cl.[7] ..... B65D 19/00

[52] U.S. Cl. ..... 108/51.3; 108/165

[58] Field of Search ..... 108/51.3, 55.1, 108/115, 165

[56] References Cited

U.S. PATENT DOCUMENTS

| | | | |
|---|---|---|---|
| 3,026,015 | 3/1962 | Severn | 108/51.3 X |
| 3,480,196 | 11/1969 | De Simas | 108/51.3 X |
| 3,519,190 | 7/1970 | Achermann et al. | 108/51.3 X |
| 3,568,912 | 3/1971 | De Simas | 108/51.3 X |
| 3,995,736 | 12/1976 | Lawson et al. | 108/51.3 X |
| 4,185,565 | 1/1980 | Nymoen | 108/51.3 |
| 4,191,288 | 3/1980 | Hostad . | |
| 4,372,221 | 2/1983 | White | 108/51.3 |
| 4,714,026 | 12/1987 | Yamaguchi et al. | 108/51.3 X |
| 4,753,341 | 6/1988 | McIntyre . | |
| 4,863,024 | 9/1989 | Booth | 108/51.3 X |
| 4,949,898 | 8/1990 | Nederveld . | |
| 4,969,559 | 11/1990 | Nederveld . | |
| 5,277,360 | 1/1994 | DeMott . | |
| 5,285,731 | 2/1994 | McIntyre . | |
| 5,314,114 | 5/1994 | Stone . | |
| 5,503,085 | 4/1996 | Rozek | 108/51.3 |

FOREIGN PATENT DOCUMENTS

| | | | |
|---|---|---|---|
| 1181764 | 6/1959 | France | 108/51.3 |
| 779014 | 4/1954 | United Kingdom | 108/51.3 |

*Primary Examiner*—Jose V. Chen
*Attorney, Agent, or Firm*—Arnold White & Durkee

[57] ABSTRACT

Assemblable display unit including integrated pallets. The display unit includes a tray configured to accommodate and receive goods and a plurality of integrated foot structures generally extending downwardly away from the periphery of the tray and supporting the tray. The foot structures are horizontally spaced from each other, defining at least one pallet aperture or channel sized to receive a loading finger. The size of the aperture varies depending upon the equipment to be used in lifting and transporting the display, whether it be a forklift, pallet jack or handcart. The display can be sized depending on the merchandise to be displayed, and thus the foot structures may define more than one opening to allow better ease of transport. The foot structures include only non-vertically-oriented raw edges to prevent water wicking.

The display units is formed from blanks of a foldable sheet material, such as double-faced corrugated fiberboard. The blanks include one tray panel, one or more sidewall-forming panels and one or more foot sections. When the blanks are folded, the sidewall-forming panels form generally vertical outer walls, and the foot sections fold to form the foot structures. Additional blanks can be folded and interconnected to form support lattices that are placed inside of the foot structures.

12 Claims, 14 Drawing Sheets

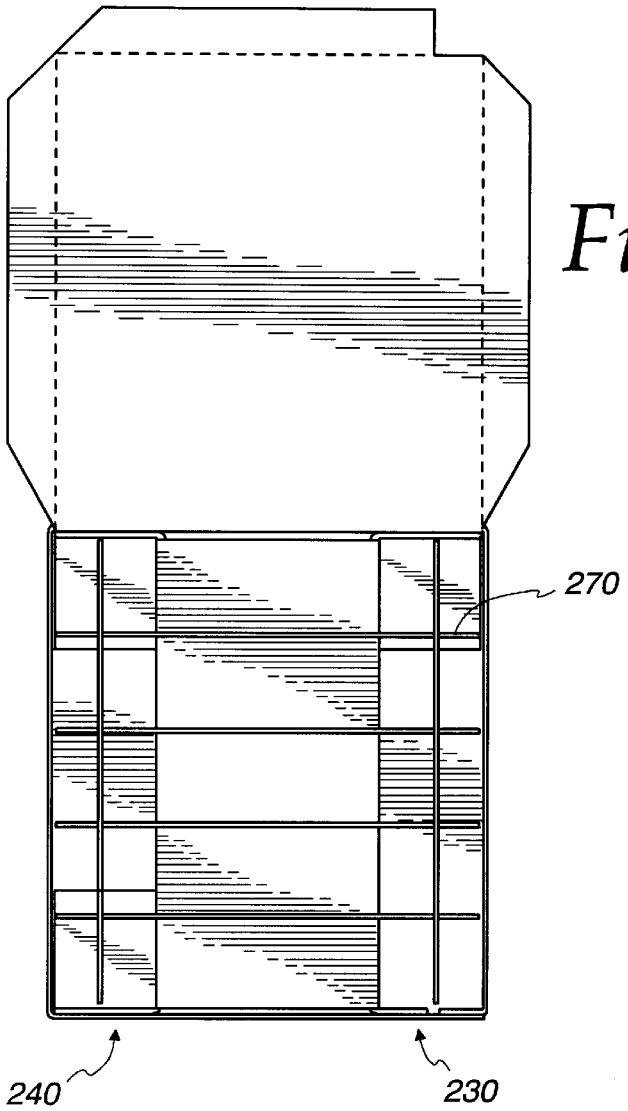
Fig. 12
Fig. 13
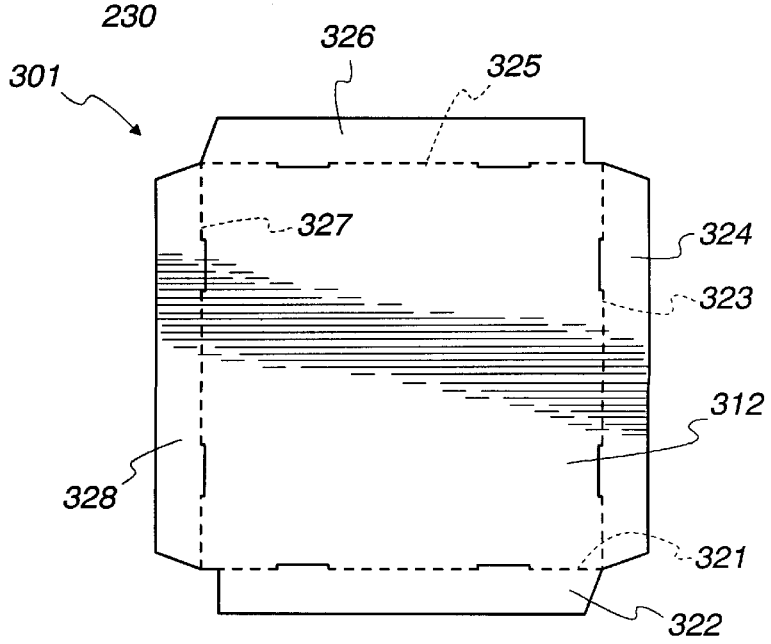

ASSEMBLABLE DISPLAY UNIT WITH INTEGRATED PALLET

This is a continuation of U.S. Ser. No. 08/636,975, filed Apr. 24, 1996, now abandoned.

BACKGROUND OF THE INVENTION

The present invention relates generally to display units used by retailers or merchandisers to exhibit products for sale. More specifically, the present invention is directed to display units made of a foldable sheet material that include an integrated pallet structure that can be assembled easily.

The attractiveness and general qualities of a display can have a direct effect on the sales of a displayed product. Various types of display units have been utilized in the market. Specifically, display units made out of foldable sheet material (e.g., double-faced corrugated fiberboard) have been utilized because of their of light weight, easy assembly, attractiveness, ability to display printed promotional material, and recyclability. Traditionally, these foldable material display units require the use of an additional wooden pallet placed underneath the display to allow transport of the display and the products using a forklift, pallet jack, or handcart. These wooden pallets often must be custom made, add additional cost to the display, and are generally considered unattractive. Additionally, wooden pallets are generally hard to recycle and produce disposal problems.

In the past, attempts have been made to build pallets of corrugated cardboard. However, these pallets have been difficult to assemble and have had to be preassembled at the factory. As a result, these pallets have been bulky, inconvenient and expensive to ship to customers. Another deficiency found with such prior art pallets is their tendency to absorb moisture, especially from liquids on the ground, and to wick this moisture into the structure of the pallet, thus severely weakening the pallet. For these and other reasons, traditional corrugated cardboard pallet designs have not proved be cost-effective in comparison to custom-made wood pallets.

Accordingly, the present invention offers a novel, durable and sturdy display unit design that includes an integrated supporting pallet. This pallet is designed to support the weight of the displayed products, allow transport by a forklift or pallet jack, and attractively display the products. In addition, the present design eliminates all exposed vertically oriented raw flute edges in the foot area, thus resisting water wicking and structural weakening. The present design is easy to assemble and does not require any special assembly tools, thus allowing the displays to be shipped flat to the customer. This ability to be shipped flat, coupled with an efficient design, allows the present design to be extremely cost-effective in comparison to custom-built wood pallets.

SUMMARY OF THE INVENTION

The present invention is generally directed to assemblable display units including integrated pallets. The display units can be used to display products at the point-of-purchase. The display unit can be assembled by the wholesaler or manufacturer of the products and the products may be shipped to the retailer already packaged inside the display unit. Alternatively, the display units can be assembled at the site. The word "products" is defined to include other display units.

Preferred embodiments are formed from blanks of a foldable sheet material, such as double-faced corrugated fiberboard. A specifically preferred embodiment of a display unit in accordance with the present invention includes a tray configured to accommodate and receive goods and a plurality of integrated foot structures or foot supports generally extending downwardly away from the periphery of the tray and supporting the tray. The foot structures are horizontally spaced from each other, defining at least one pallet aperture or channel sized to receive a loading finger. The size of the aperture will vary depending upon the equipment to be used in lifting and transporting the display, whether it be a forklift, pallet jack or handcart. The display can be sized depending on the merchandise to be displayed, and thus the foot structures may define more than one opening to allow better ease of transport.

The preferred embodiments also prevent structural weakening caused by water wicking by eliminating all exposed vertically-oriented raw edges along the foot structures.

Foldably interconnected display wall panels may extend in preferred embodiments generally upwardly away from the periphery of the tray. Wall panels for the preferred embodiments are configured to receive, retain and display different types of products.

Structurally, the display unit comprises at least one blank of foldable sheet material. The blanks of a preferred embodiment includes at least one tray panel, one or more sidewall-forming panels and one or more foot sections. When the blank is folded, the tray panel is placed in the generally horizontal position to receive the products, the sidewall-forming panels form generally vertical outer walls, and the foot sections fold to form the foot structures. When folded the foot structures define the channels suitable for receiving the loading fingers. Additional blanks can be folded and interconnected, such as by sliding grooves, to form support lattices that are placed inside of the foot structures to add additional strength to the display and to further support the display tray.

BRIEF DESCRIPTION OF THE DRAWINGS

FIG. 12 is a plan view of the second display unit illustrated in FIG. 10 before the tray panel is folded into its final position, showing supplementary support structures.

FIG. 13 is a plan view of a primary blank for a third embodiment of a display unit in accordance with the present invention.

DETAILED DESCRIPTION OF THE INVENTION

Figure 1:
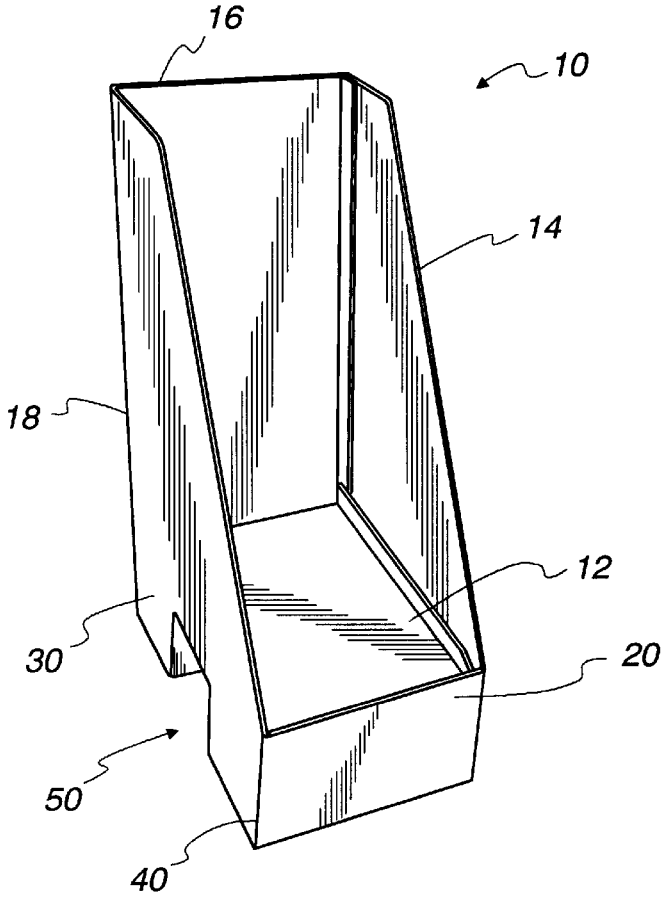
FIG. 1 is a front perspective view of a first embodiment of a display unit in accordance with the present invention.
Figure 2:
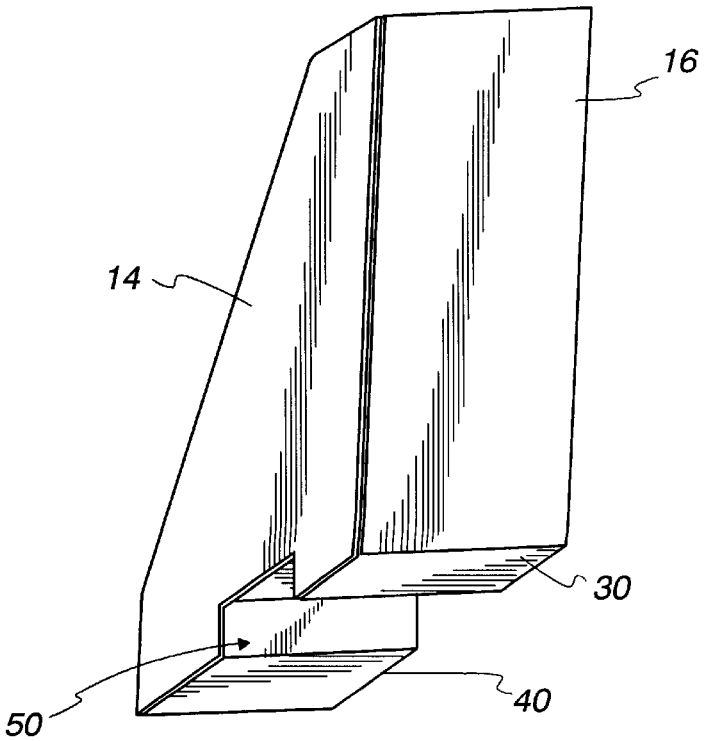
FIG. 2 is a back and bottom perspective view of the display unit illustrated in FIG. 1.

A first embodiment of a display unit 10 in accordance with the present invention is depicted in FIGS. 1 and 2. Display unit 10 includes a tray-forming panel 12, a first sidewall-forming panel 14, a backwall-forming panel 16, a second sidewall-forming panel 18 and a frontwall-forming panel 20. Display unit 10 also includes a first foot structure 30 and a second foot structure 40.

When display unit 10 is assembled, the display tray 12 is in a generally horizontal position. The sidewalls 14 and 18, backwall 16 and frontwall 20 extend in a generally vertical direction upwardly away from the periphery of the display tray. The foot structures 30 and 40 support the display tray 12 and extend generally downwardly away from the display tray 12. The foot structures 30 and 40 are horizontally spaced from each other and define a channel 50 suitable for receiving a loading finger.

Figure 3:
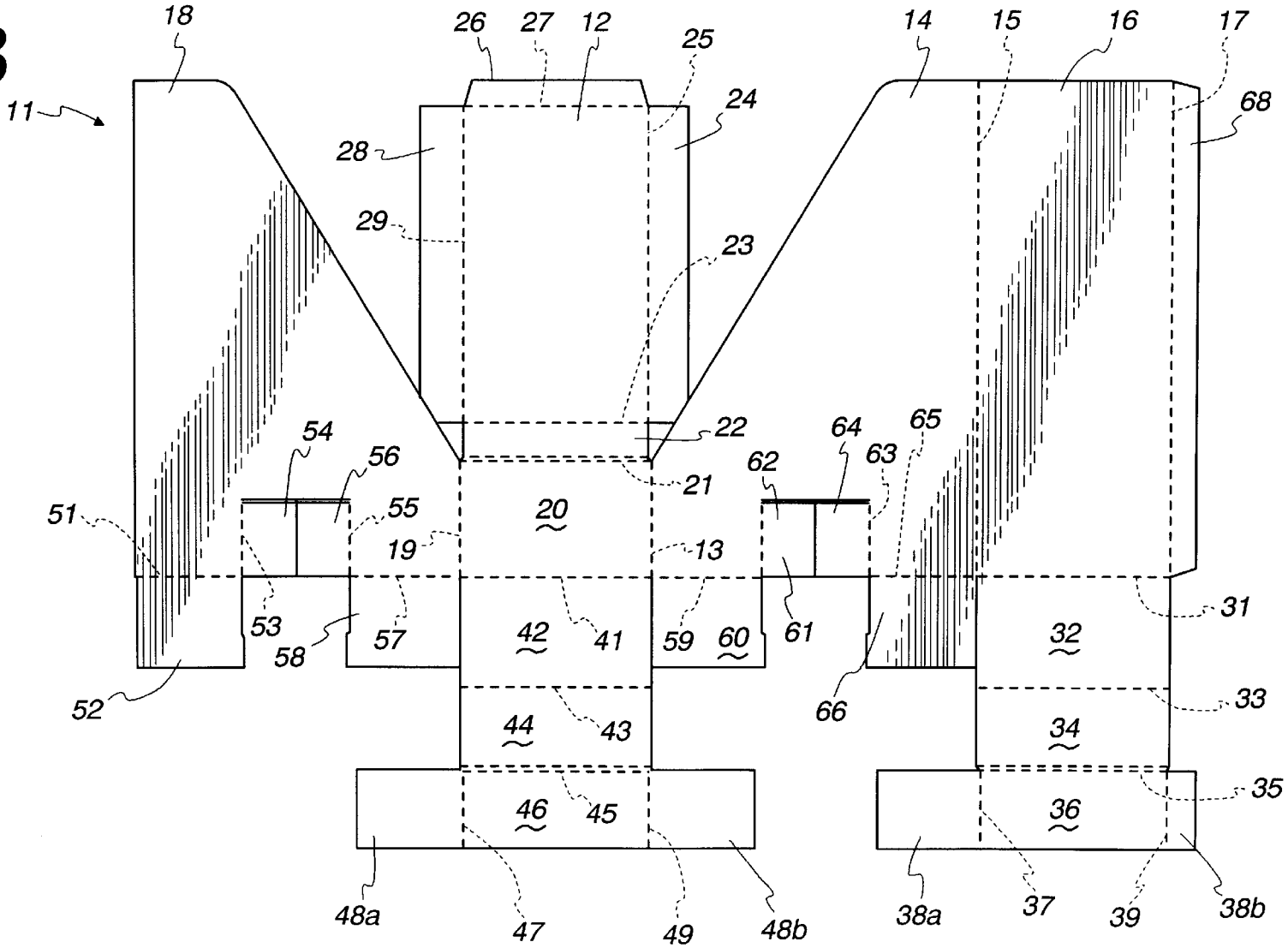
FIG. 3 is a top plan view of a primary blank for the display unit illustrated in FIG. 1.

FIG. 3 shows a primary blank 11 including the tray-forming multilateral (e.g., rectangular) panel 12. Tray-forming panel 12 has three side securing panels 24, 26 and 28, foldably connected to the first side, distal end, and second side of tray-forming panel 12, at foldlines 25, 27 and 29 respectively. Bottom tray folding panel 12 is foldably connected at its proximal edge to an inner front-wall-forming panel 22 by foldline 23. An outer frontwall-forming panel 20 is coupled to panel 22 by double foldline 21. Opposite side edges of the frontwall-forming panel 20 (which is rectangular) are each connected to generally complementary side-wall-forming panels 14 and 18.

In the present embodiment, the sidewall-forming panels 14, 18 are generally shaped to have a tray-panel-facing edge angled to approximately 60°. Tuck-in flaps 54, 56 and 62, 64 are foldably connected at foldlines 53, 55 and 61, 63, respectively, to inside edges of sidewall-forming panels 18 and 14. Tuck-under flaps 52, 58 and 60, 66 are foldably coupled to outer edge portions of the proximal end of panels 18 and 14 respectively, at foldlines 51, 57, 59, and 65.

Backwall-forming panel 16 is foldably connected to a second side edge of sidewall-forming panel 14 at foldline 15. Backwall-forming panel 16 has a securing flap 68 foldably connected at foldline 17 to a side edge peripherally opposed to the edge that connects to sidewall-forming panel 14.

A bottom foot panel 42 is foldably connected to a proximal edge of frontwall-forming panel 20. A side foot panel 44 is foldably connected to a proximal edge of bottom foot panel 42, at foldline 43, and a tuck-around foot panel 46 is foldably connected to a proximal edge of side foot panel 44 at double foldline 45. Tuck-in foot flaps 48*a* and 48*b* are foldably connected to the lateral edges of panel 46. In a similar fashion, second bottom foot panel 32, second side foot panel 34, second tuck-around foot panel 36 are all sequentially foldably connected to a proximal edge of backwall-forming panel 16. Tuck-in edges 38*a* and 38*b* are foldably connected to lateral edges of panel 36. All panels are generally rectangular with the exception of panels 18 and 14 which extend a predetermined angle Θ away from foldline 21 (e.g., Θ=60°). However, depending on the product to be displayed and the desires of the customer, all the present designs can be readily altered by those knowledgeable in the art to accommodate other shapes and dimensions.

Figure 4:
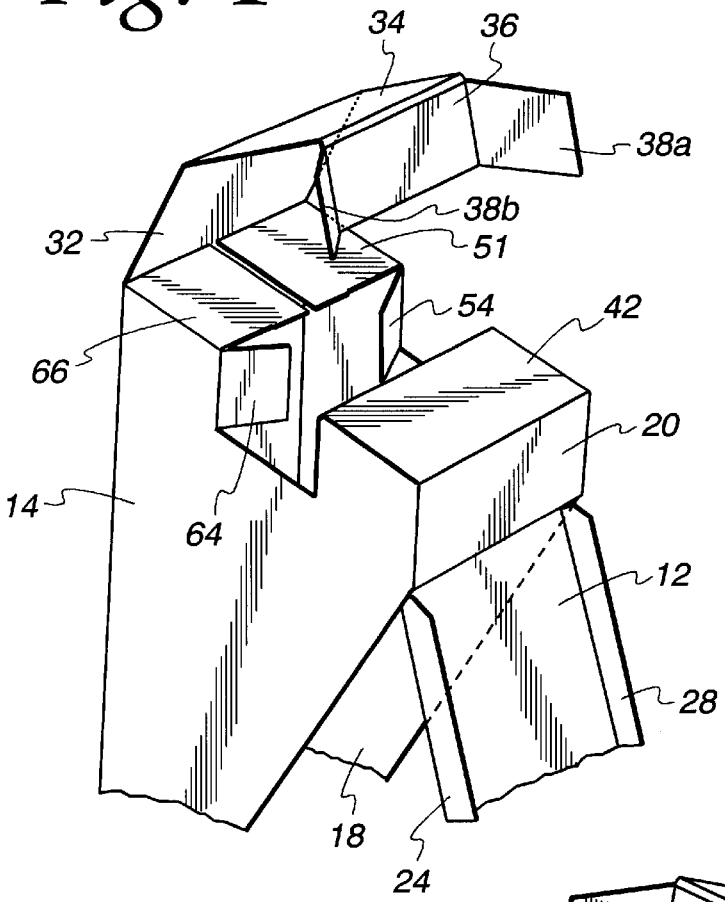
FIG. 4 is a perspective bottom view of the display unit illustrated in FIG. 1, showing folding details for a first foot structure.
Figure 5:
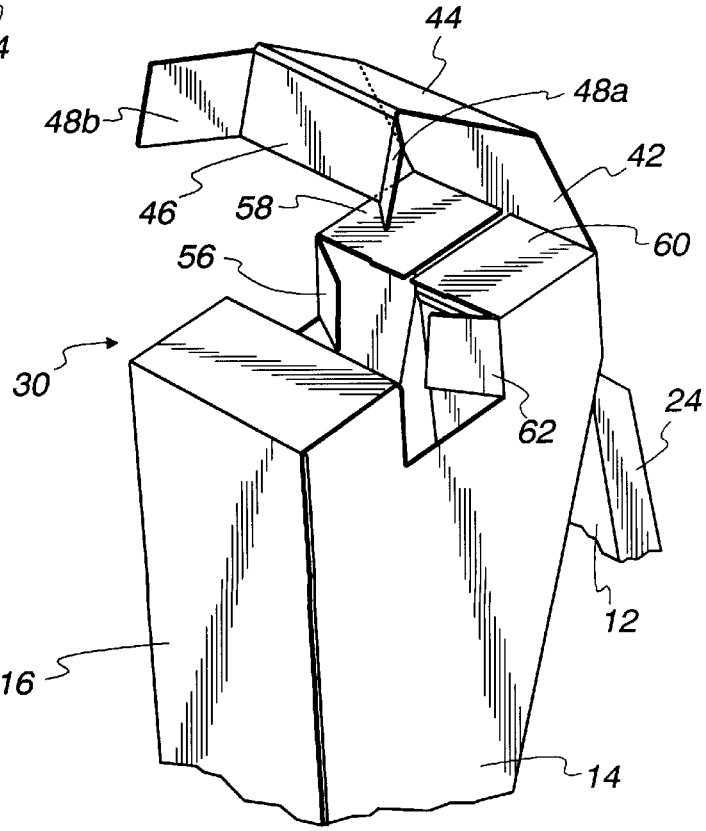
FIG. 5 is a perspective bottom view of the display unit illustrated in FIG. 1, showing folding details for a second foot structure.

FIGS. 4 and 5 show the assembly of primary blank 11 into display unit 10. With the exception of foldlines 23, 25, 29, 38 and 48 which are folded outwardly 90°, single folds are generally folded inwardly (i.e., away from the observer according to FIG. 3) 90°. Double folds are generally folded inwardly 180°. (Since display unit 10 is generally symmetrical, these directions may be reversed if desired.) The sidewall panels 14 and 18 are folded about foldlines 13 and 19 perpendicularly to the front wall panel 20. Foot structure 30 is formed, as illustrated in FIG. 4, by folding flaps 52 and 66 about foldline 51 and 65 and folding flaps 64 and 54 about foldline 63 and 53. Panels 32, 34, and 36 are folded over the resulting box-like structure at foldlines 31, 33, and 35. Tuck-around foot panel 36 is placed around flaps 54 and 64 and is secured in place by flaps 38*a* and 38*b*.

Likewise, as shown in FIG. 5, foot structure 40 is formed by folding flaps 58 and 60 about foldlines 57 and 59 respectively and folding flaps 62 and 56 about foldlines 61 and 55. Panels 42, 44, and 46 are folded over this resulting box-like structure with panel 46 being secured around flaps 56 and 62 by flaps 48*a* and 48*b*. Both foot structure 30 and 40 include a "wrap-around" design, where the bottom foot panels 32 and 42 cover any vertical raw edges and are disposed in a generally horizontal orientation to provide a generally horizontal ground contact surface (that is, the surface of the display unit in contact with the surface on which the display unit is placed). Raw edges are the exposed cross-sectional edges that result at cuts for materials such as corrugated cardboard. Due to longitudinal channels present in the structure of corrugated cardboard, vertically exposed raw edges have been discovered to act as channels that flute moisture upwardly into the structure of display units. In addition to providing a generally horizontal panel as a ground contact area, foot structures 30 and 40 include outer panels, that is, panels that are visible when the display unit 10 is assembled, only having non-vertically oriented exposed raw edges to resist moisture wicking.

Figure 6:
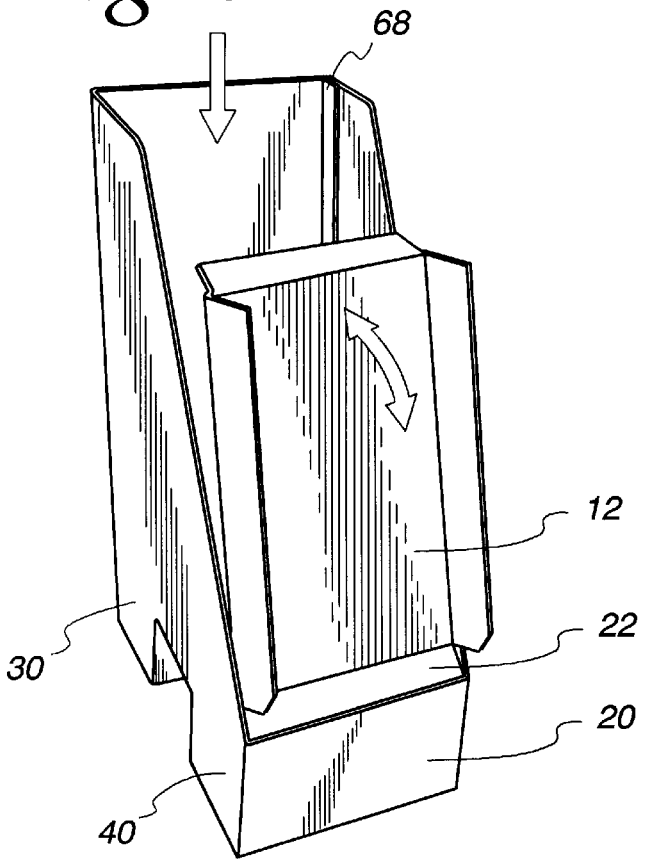
FIG. 6 is a perspective view of the display unit illustrated in FIG. 1, showing folding details for the tray panel.

As shown in FIG. 6, the tray-forming panel 12 is then folded in to a generally horizontal position. In a preferred assembly method, securing flap 68 is glued against panel 18. Although it is not necessary, the shape of display unit 10 alternatively can be secured by using fasteners, glue, staples, and other methods known in the art.

Figure 7:
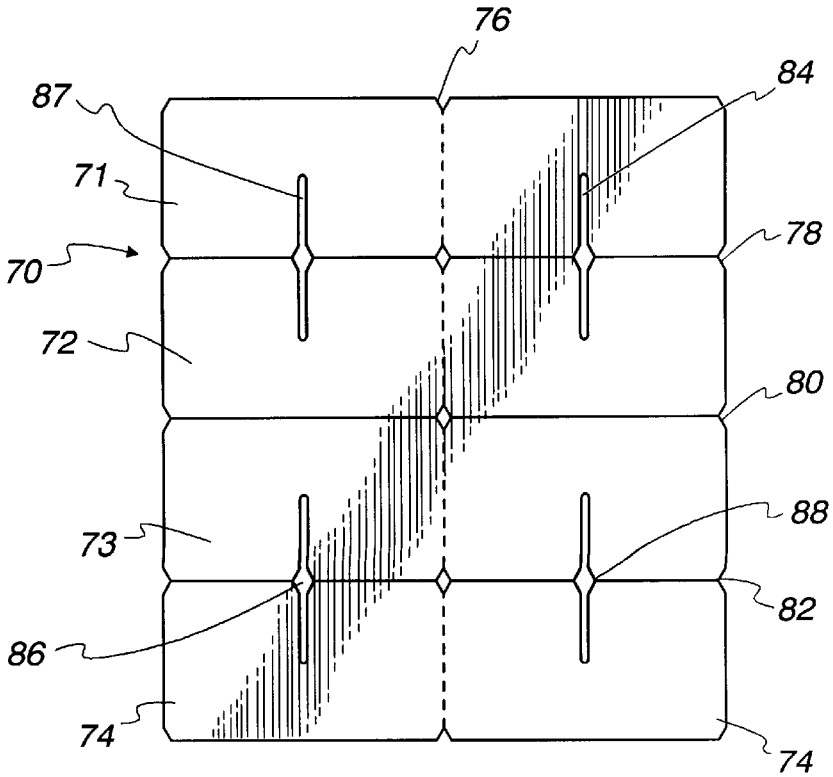
FIG. 7 is a top plan view of the secondary blank used for-forming supplementary foot support structures.
Figure 8:
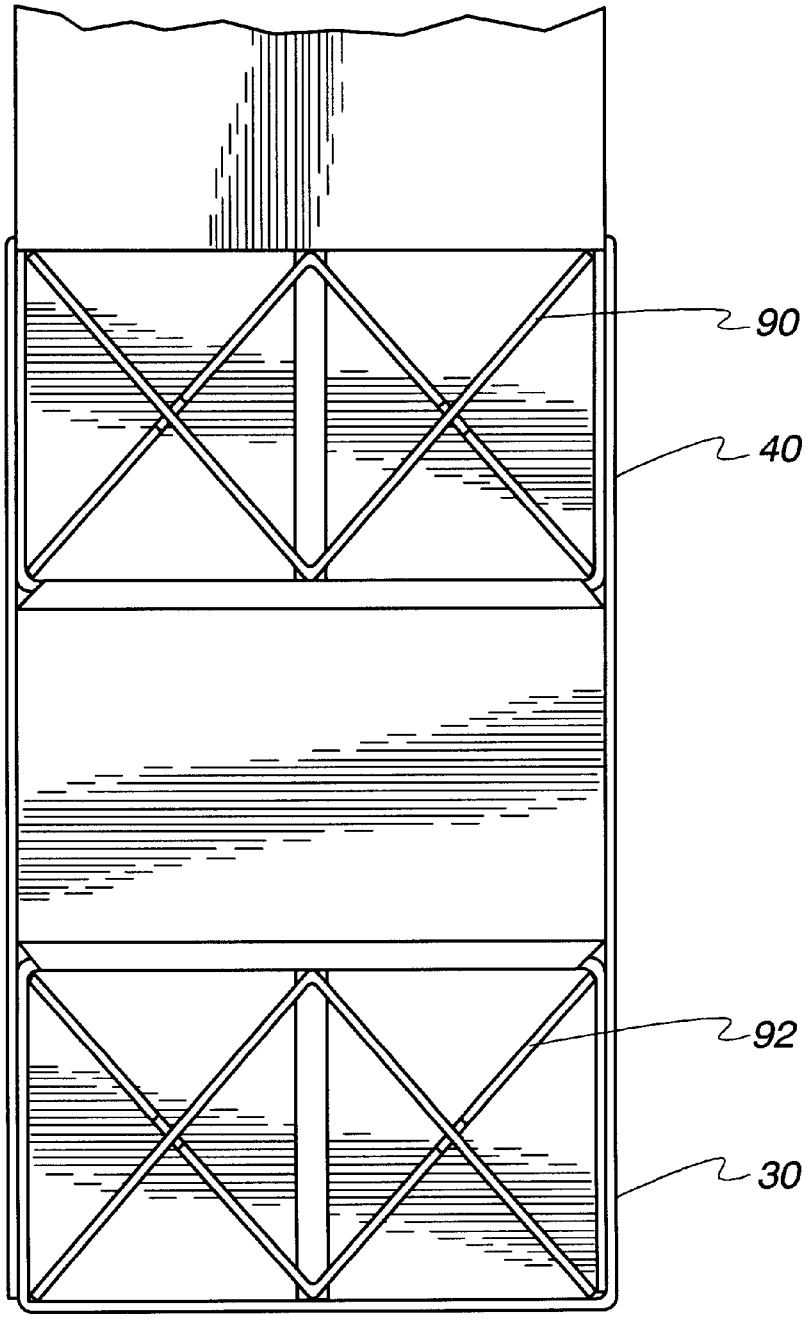
FIG. 8 is a top plan view of the display unit illustrated in FIG. 1 before the tray panel is folded into its final position, showing the supplementary foot support structures placed inside of the foot structures.

FIG. 7 shows a secondary blank 70. Blank 70 can be used to construct foot support structures to be placed inside of foot supports 30 and 40. Secondary blank 70 includes four generally identically sized segments 71, 72, 73 and 74 removably connected along three latitudinal perforations 78, 80 and 82. Each segment has a height generally equal to the distance between the upper surface of panels 58 and 60 (or 52 and 66) and the lower surface of tray panel 12. The segments include an axial longitudinal foldline 76. Longitudinal slots 82 and 84, located at ¼ and at ¾ of the width of the blank 70, extend radially from foldline 78 for approximately half the height of each segment. Longitudinal slots 86 and 88 similarly extend radially from foldline 82. During assembly, segments 71, 72, 73 and 74 are separated and then folded along foldline 76. Segment 71 is coupled to segment 72 and segment 73 is coupled to segment 74 by engaging complementary halves of each groove 82, 84, 86 and 88 to form a lattice structure. The completed support structures 90 and 92 are placed inside of foot structures 30 and 40 as shown in FIG. 8.

Figure 9:
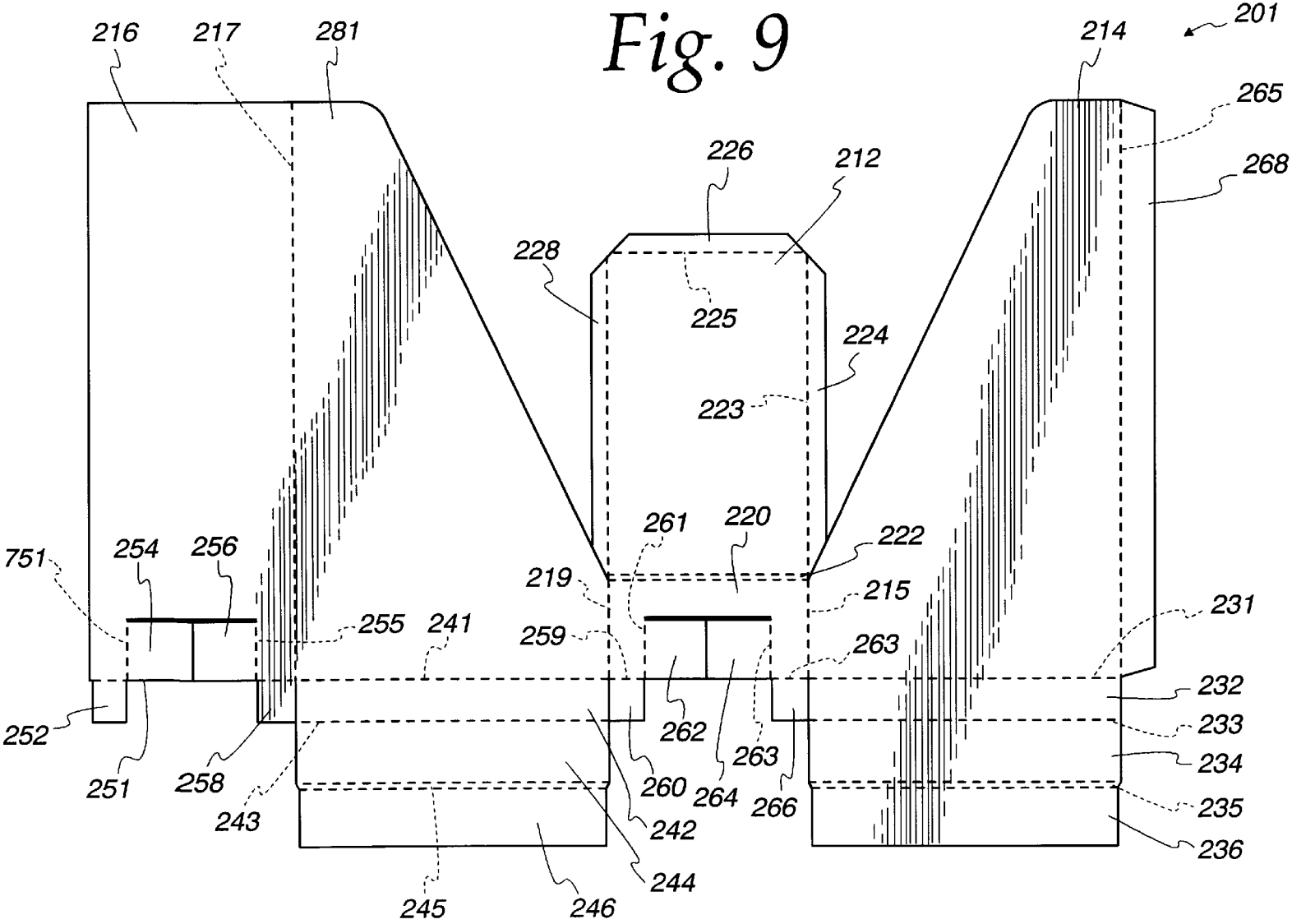
FIG. 9 is a top plan view of a primary blank for a second embodiment of a display unit in accordance with the present invention.

FIG. 9 depicts a primary blank 201 of a second embodiment of a display unit in accordance with the present invention. Blank 201 includes a display tray panel 212. Tray-securing flap 226 is foldably connected along foldline 225 to a distal end of tray panel 212. A second and a third tray-securing flaps 228 and 224 are foldably connected, by foldlines 227 and 223 respectively, to the side edges of panel 212. A frontwall-forming panel 220 is foldably connected to a proximal end of tray panel 212 by a double foldline 222. Sidewall-forming panels 214 and 218 are connected to opposite side edges of frontwall-forming panel 20 at foldlines 215 and 219 respectively. A backwall-forming panel 216 is foldably connected to a second side edge of sidewall-forming panel 218 opposite panel 220 at foldline 217. A securing flap 268 is connected to a second side edge of sidewall-forming panel 214 at foldline 265. Two securing tabs 262 and 264 are foldably connected to two inner vertical edges of frontwall-forming panel 220 at foldlines 261 and 263 respectively. A foot bottom panel 232 is foldably coupled to a proximal edge of sidewall-forming panel 214 at foldline 231. A foot side panel 234 is foldably coupled to a proximal edge of panel 232 at foldline 233. A foot tuck-over panel 236 is then connected in sequence to the proximal edge of panel 234 at foldline 235. In a similar fashion, a second foot bottom panel 242, a second foot side panel 244, and a second foot tuck under panel 246 are sequentially connected to a proximal edge of sidewall-forming panel 218 at foldlines 241, 243, and 245, respectively. Foldlines 235 and 245 are double foldlines. Securing tabs 258 and 264 are foldably connected at foldlines 259 and 263 to corner portions of the proximal edge of front panel 220. Securing tabs 254 and 256 are connected at foldlines 251 and 255 respectively to inner longitudinal edges of backwall-forming panel 216. Securing tabs 252 and 254 are connected at fold 251 to corner portions of a proximal edge of backwall-forming panel 216.

Figure 10:
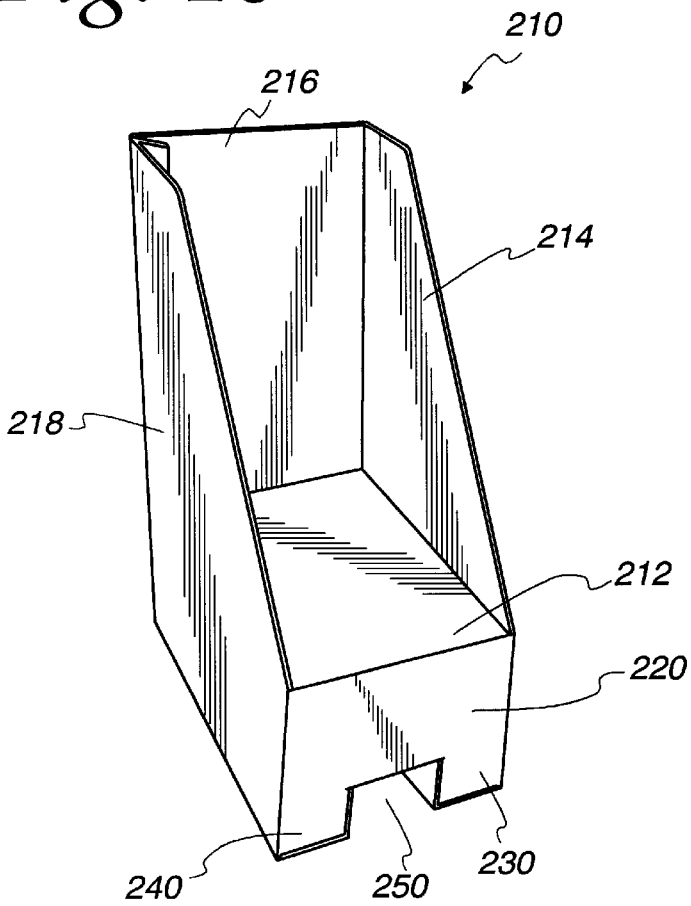
FIG. 10 is a perspective front and top view of the assembled second embodiment of a display unit.
Figure 11:
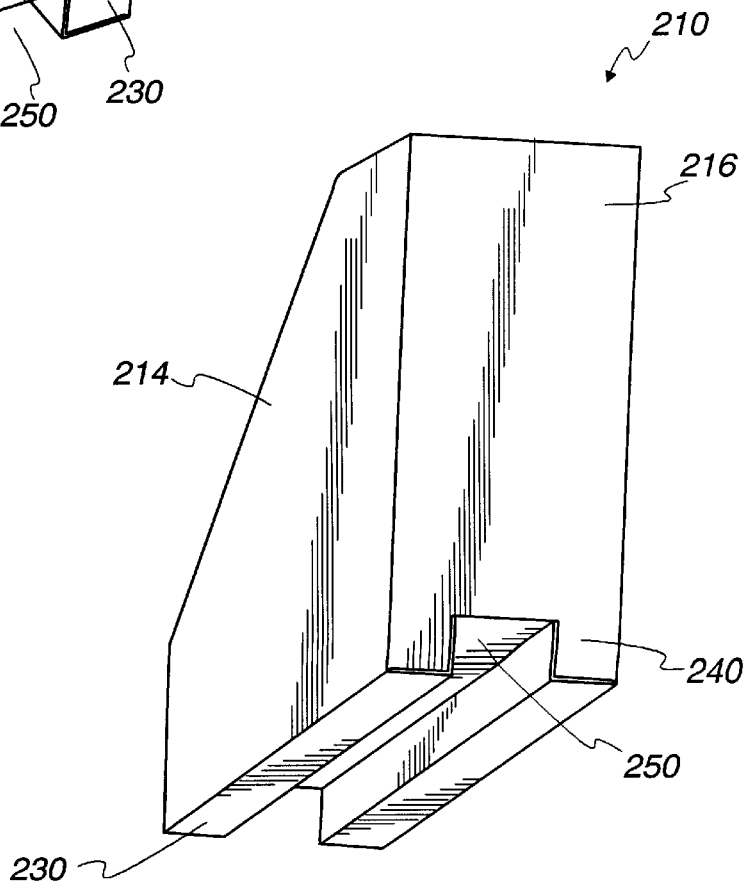
FIG. 11 is a perspective back and bottom view of the second embodiment of a display unit illustrated in FIG. 10.

FIGS. 10 and 11, show display unit 210 assembled from primary blank 201 in a fashion similar to the assembly of previously discussed display unit 10. Single folds are generally folded inwardly approximately 90°, while double folds are folded inwardly generally 180°. Assembled tray 212 is placed in a generally horizontal plane. Sidewalls 214 and 218 extend along vertical planes generally parallel to each other and generally perpendicular to tray 212. Backwall 216 is generally perpendicular to both sidewall panels 218 and 214 and has a generally vertical orientation extending upwardly away from the periphery of tray 212. Frontwall 220 is generally perpendicular to tray 212 and extends generally downwardly away from the periphery of tray 212. Foot structures 230 and 240 also extend downwardly away from the service of tray 212 and are generally aligned with walls 218 and 214 respectively. Together, foot structures 230 and 240 define a channel 250 suitable for receiving the loading finger of a forklift, pallet tray, or hand cart. As with the display unit 10, the foot structures of the present embodiment do not include any vertically oriented exposed raw edges. The channel 250 can be sized in accordance with the size of the display, the expected weight to be received and the loading machine expected to be used. As shown in FIG. 12, additional support structures 270 can be placed inside of the foot structures 240 and 230 of display unit 210 to further strengthen the unit.

FIG. 13 shows a primary blank 301 used in the assembly of a third embodiment of a display unit in accordance with the present invention. Blank 301 includes a tray panel 312 shaped generally as a square. Other shapes and dimensions are clearly possible. Four side panels 322, 324, 326 and 328 are foldably coupled to each edge of panel 312 by foldlines 321, 323, 325 and 327 respectively.

Figure 14:
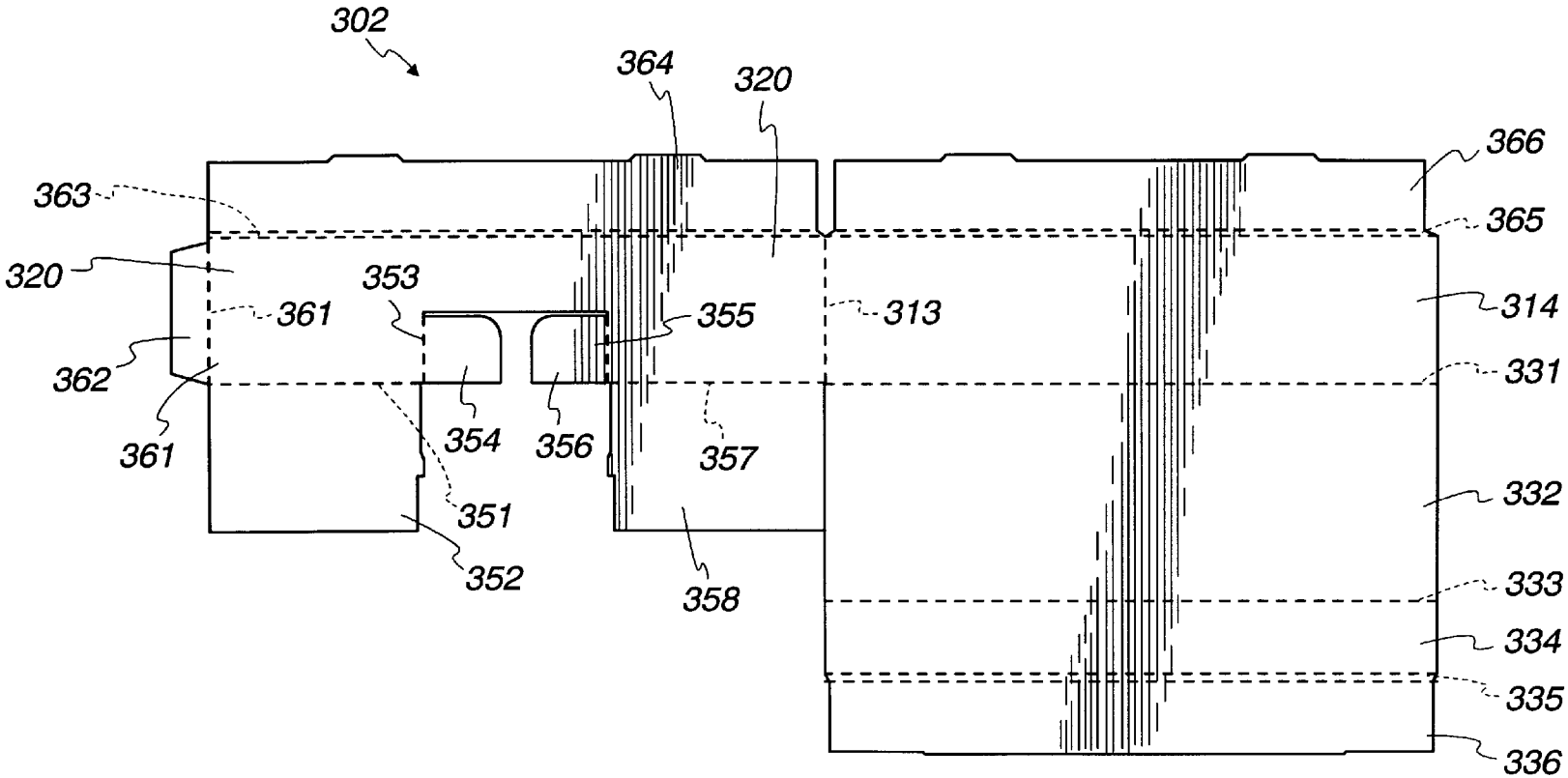
FIG. 14 is a top plan view of a secondary blank for a third embodiment of a display unit in accordance with the present invention.

FIG. 14 shows a secondary blank 302 which is utilized to form a frontwall, first sidewall, and first foot structure of the third embodiment of the display unit. A second secondary blank 303 (not shown) is used to form the backwall, second sidewall and second foot structure of this embodiment. Since blanks 302 and 303 are mirror images of each other, description will only be given for first secondary blank 302. Blank 302 includes an outer frontwall-forming panel 320 which is foldably attached at foldline 313 to a side edge of an outer sidewall-forming panel 314. A first inner sidewall panel 362 is foldably connected to an opposite side edge of panel 320 at foldline 361. A second inner sidewall panel 366 is foldably connected by a double fold 365 to the distal edge of outer sidewall-forming panel 314. Tuck-under panels 352 and 358 are foldably connected at outer portions the proximal edge of front panel 320 at foldlines 351 and 357. A foot bottom panel 332 is foldably connected to a proximal edge of outer sidewall-forming panel 314 at foldline 331. A foot side panel 334 is foldably connected to the proximal edge of foot bottom panel 332 at foldline 333. Foot tuck-over panel 336 is foldably coupled to the proximal edge of panel 334 at double foldline 335.

Figure 15:
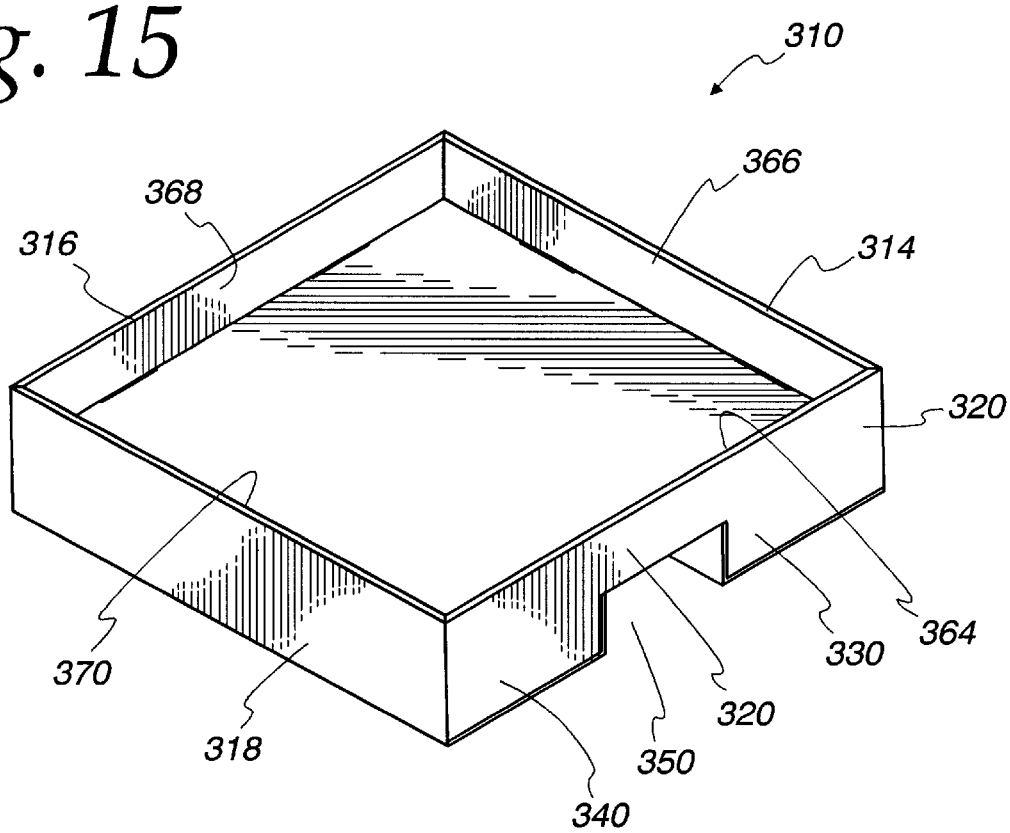
FIG. 15 is a perspective top view of the assembled third embodiment of a display unit.
Figure 16:
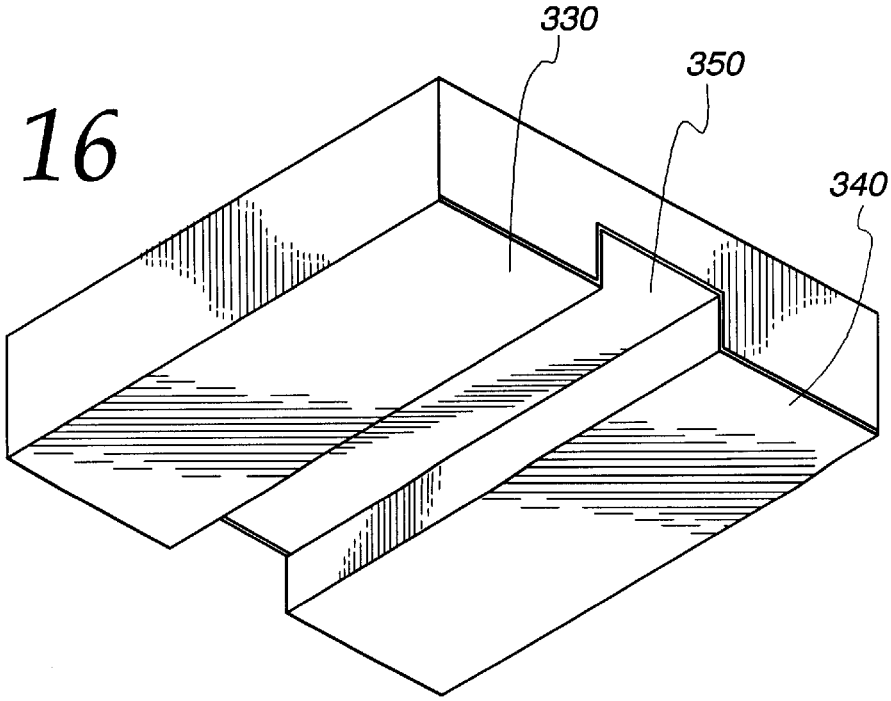
FIG. 16 is a bottom perspective view of view of the third embodiment of a display unit illustrated in FIG. 15.

FIGS. 15 and 16 depict display unit 310 assembled from blanks 301, 302 and 303. Display unit 310 is configured to be used by itself or as a recyclable pallet for other display units. Again, single foldlines are generally folded inwardly 90° and double foldlines are folded inwardly 180°. Tray 312 is placed in a generally horizontal position and is secured by panels 322, 324, 326 and 328 . Inner sidewall-forming panels 364, 366, 368 and 370 (from secondary blank 303) are secured into slots on the periphery of tray panel 312 to form inner sidewalls generally perpendicular to the surface of the tray panel 312. Panels 320, 314 and 316, 318 (from the complimentary secondary blank 303) form an outer walls. Foot structures 330 and 340 extend generally perpendicularly away in a downward direction from the tray 312 and together define a middle channel 350 suitable for receiving a loading finger.

Figure 17:
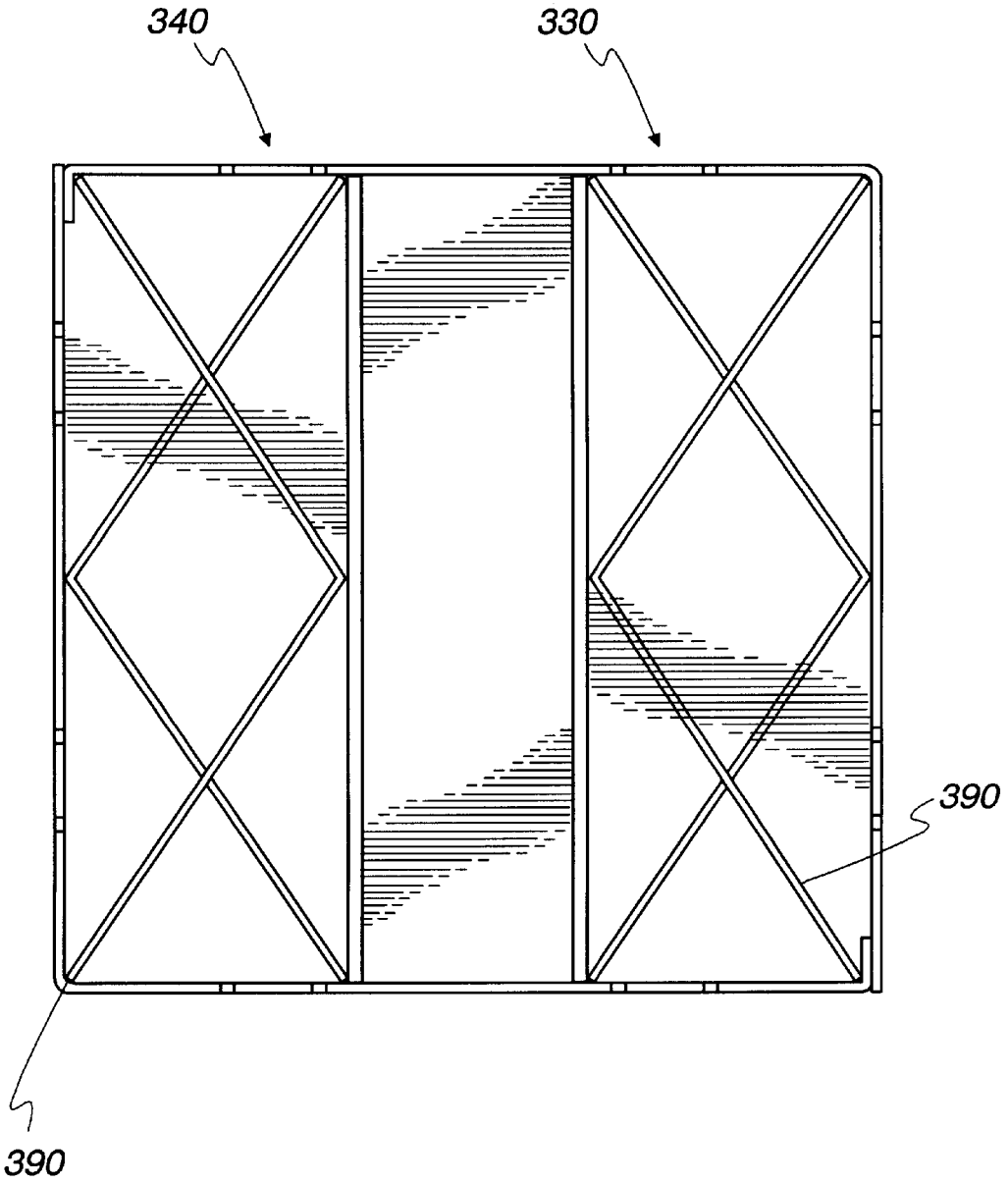
FIG. 17 is a partial top view of the third display unit illustrated in FIG. 15 with the tray panel removed, showing support structures.

As with the previously described embodiments, supporting structures 390, shown in FIG. 17, can be placed inside of foot structures 330 and 340 to add strength to the display unit 310.

Figure 18:
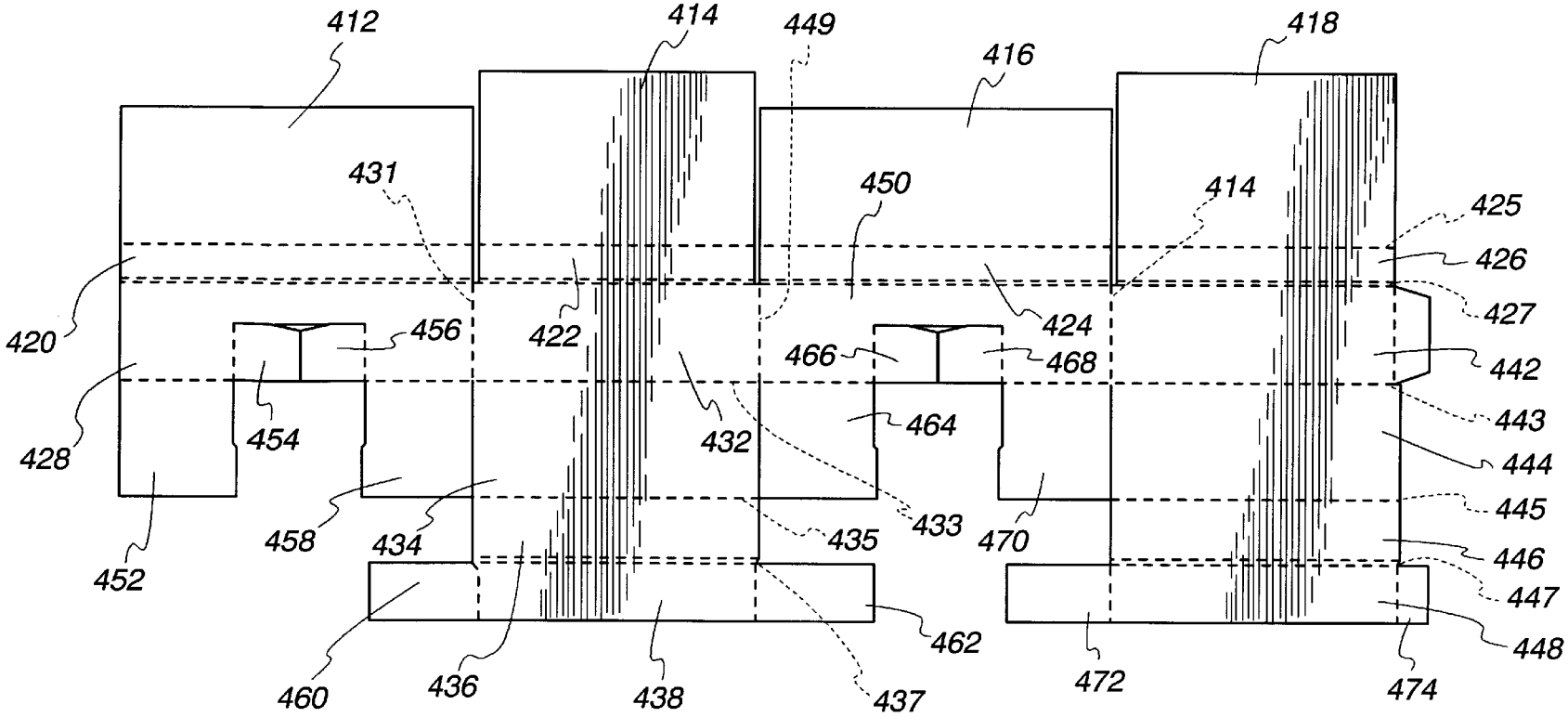
FIG. 18 is a top plan view of a primary blank of a fourth embodiment of a display unit in accordance with the present invention.

FIG. 18 illustrates a primary blank 401 for a fourth embodiment of a display unit in accordance with the present invention. Bland 401 includes four tray panels 412, 414, 416 and 418. Each tray panel is foldably connected to a respective inner wall 420, 422, 424, and 426 at a proximal edge. In turn, the inner walls are foldably connected at their proximal edge by a double foldline 427 to wall-forming panels 428, 432, 450 and 442. Panel 428 is foldably connected on a side edge to panel 432 by foldline 431. Panel 432 is foldably connected at an opposite side edge to panel 450 at foldline 449. Panel 450 is foldably connected on an opposite side edge at panel 442 at fold 441. Securing panels 454 and 456 are foldably connected to inner inside edges of panel 428 at foldlines 453 and 455 respectively. Securing panels 452 and 458 are foldably connected to outside corners of the proximal edge of panel 428. Bottom foot panel 434, side foot panel 436, and securing foot panel 438 are all successively connected to panel 432 by foldlines 433, 435 and double foldline 437 respectively. Closure tabs 460 and 462 extend from opposite side edges of panel 438. Securing panels 466 and 468 are foldably connected to inside edges of panel 450 at foldlines 465 and 467. Securing panels 464 and 470 are foldably connected to corner sections of the proximal edge of panel 450. Second foot bottom panel, second foot side panel 446 and second foot securing panel 448 are also sequentially connected to sidewall-forming panel 442 at foldlines 443, 445, and double foldline 447. Closure tabs 472 and 474 are connected to opposite side edges of panel 448.

Figure 19:
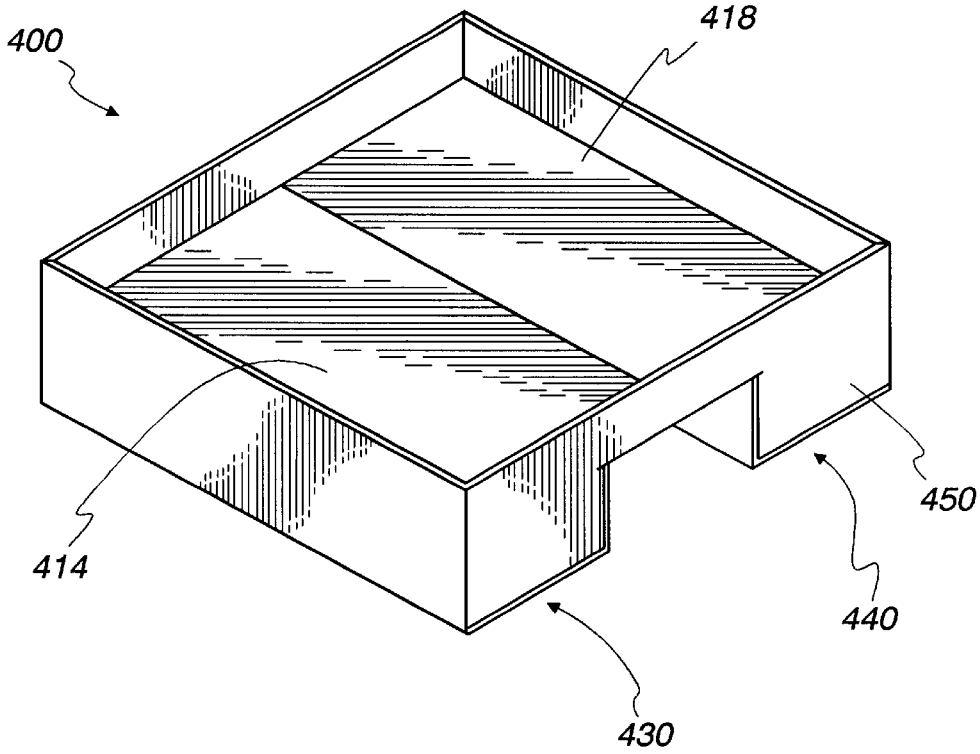
FIG. 19 a perspective top view of the assembled fourth embodiment of a display unit in accordance with the present invention.
Figure 20:
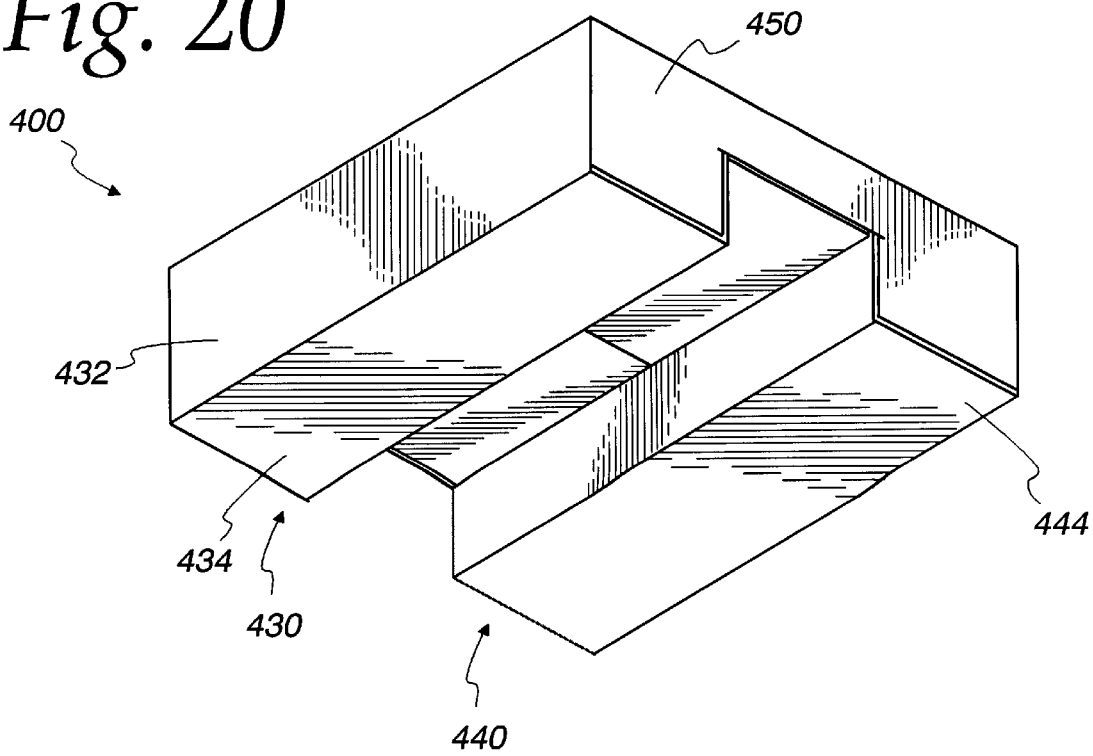
FIG. 20 is a perspective bottom view of the display unit illustrated in FIG. 19.

FIGS. 19 and 20 illustrate display unit 400 when assembled. Tray panels 414 and 418 are first folded at foldline 425 to a generally horizontal position while inner sidewalls are formed by panels 422 and 424 in a generally vertical position. A box-like structure is accomplished by bending the blank approximately 90° at foldlines 431, 449, and 441. Tray panels 412 and 416 are then folded to a generally horizontal position with panels 420 and 424-forming inner sidewalls. Panels 428, 432, 450 and 442 form outer sidewalls when the blank is bent approximately 180° at double foldline 427. Tabs 452, 458, 464 and 470 are bent in approximately 90°. Likewise, tabs 454, 456, 466 and 468 are also bent inward approximately 90°. Foot structures 430 and 440 are then created by folding the bottom foot panels 434 and 444 over tabs 458 and 464 and 470 and 452 respectively. Foot side panels form the side of the foot structures while securing panels 438 and 448 are secured under the tray panels by closure tabs 460 and 462 and 472 and 474 respectively.

Figure 21:
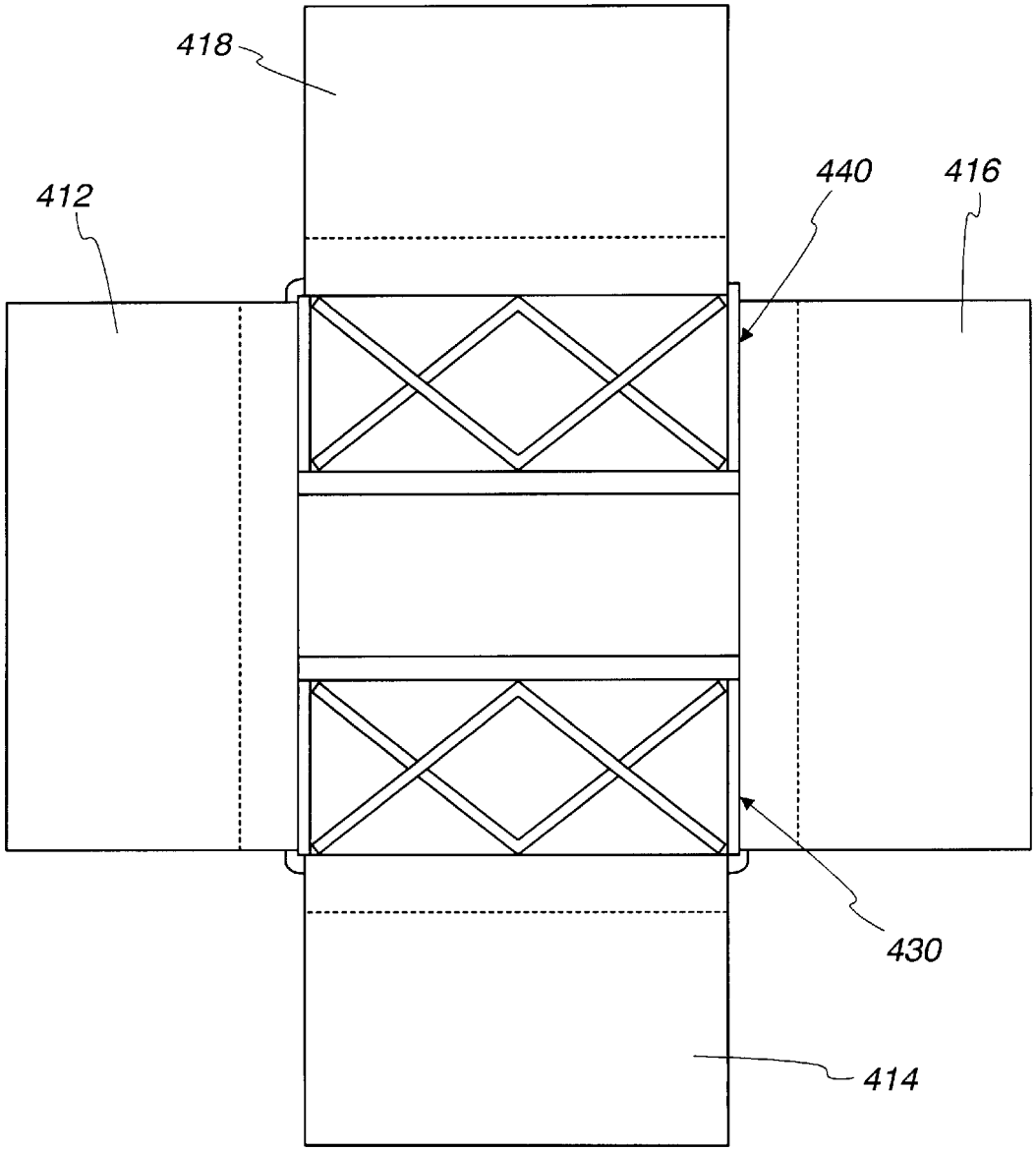
FIG. 21 is a top plane view of the display unit shown in FIG. 19 with the tray panels unfolded, showing support structures.

Support structures can be placed inside of foot structures 430 and 440 as shown in FIG. 21. These foot structures are constructed in a similar fashion as the foot structures shown for the display unit 10 of FIGS. 1 and 2.

As can be seen from all the present embodiments, each display unit can be shipped flat and assembled at the point of purchase by the customer. No specialized tools are required to construct the display units which may be secured by common fasteners or adhesives known in the art. The "wrap-around" design of the foot structures is aimed so as to avoid any raw exposed vertical edges that may wick away moisture into the display unit, thus weakening it. The size and shape of the sidewalls and of the container itself may vary from that shown without departing from the scope of the invention, depending on the type, size and amount of products to be displayed.

What is claimed is:

1. An assemblable display unit for placing on a generally horizontal surface for receiving and displaying products, comprising:

a display tray configured to accommodate, display and receive goods;

at least one wall panel extending generally vertically around at least a portion of the periphery of the tray;

at least one integrated foot support generally extending downwardly away from said tray and supporting said tray, said foot support defining at least one pallet aperture generally located at a lower portion of the display unit sized to receive a loading finger; said foot support having a generally box-like structure having closed ends, the ends including an integral lower portion of the wall panel;

wherein the display unit is formed from a primary blank of a foldable sheet of material including a first outer wall-forming panel having integral first and a second foot support portions extending from a lower section of the first outer-wall forming panel, a second outer wall-forming panel having a first side edge foldably connected to a first side edge of the first outer wall-forming panel, a third outer wall-forming panel having a first side edge foldably connected to a second side edge of the second outer wall-forming panel and integral first and a second foot support portions extending from a lower section of the third outer-wall forming panel, a fourth outer wall-forming panel having a first side edge foldably connected to a second side edge of the third outer wall-forming panel, a first inner wall-forming panel foldably connected to an upper edge of the first outer wall-forming panel, a second inner wall-forming panel foldably connected to an upper edge of the second outer wall-forming panel, a third inner wall-forming panel foldably connected to an upper edge of the third outer wall-forming panel, a fourth inner wall-forming panel foldably connected to an upper edge of the fourth outer wall-forming panel, a first tray-forming panel foldably connected to an upper edge of the first inner wall-forming panel, a second tray-forming panel foldably connected to an upper edge of the second inner wall-forming panel, a third tray-forming panel foldably connected to an upper edge of the third inner wall-forming panel, a fourth tray-forming panel foldably connected to an upper edge of the fourth inner wall-forming panel, a first bottom foot panel foldably connected to a lower edge of the second wall-forming panel and a second bottom foot panel foldably connected to a lower edge of the fourth wall-forming panel;

wherein when the display unit is setup, the bottom foot panels fold in a generally horizontal alignment over the first and second foot support portions of the wall-forming panels.

2. A display unit for receiving and displaying products, the display unit being assemblable from a primary blank of a foldable sheet material and comprising:

a generally rectangular display tray having a front edge, back edge and two opposing side edges, the display tray having a generally horizontal orientation upon assembly of the display unit so as to accommodate, display and receive goods;

a front wall positioned generally adjacent to the front edge of the display tray and having a generally vertical orientation upon assembly of the display unit, the front wall comprising a first and second frontwall-forming panel hingedly connected and folded relative to each other, the first frontwall-forming panel being hingedly connected to and extending generally vertically upwardly from the front edge of the display tray to define an inner portion of the front wall, the second frontwall-forming panel being hingedly connected to and extending generally downwardly from the first frontwall-forming panel to define an outer portion of the front wall, wherein upon assembly, an uppermost portion of the front wall extends a relatively short distance above the display tray so as to permit viewing of goods placed on the display tray from a position outside and in front of the front wall;

a pair of opposing sidewalls each positioned generally adjacent to one of the opposing side edges of the display unit and having a generally vertical orientation upon assembly of the display unit;

a backwall positioned generally adjacent to the back edge of the display tray and having a generally vertical orientation upon assembly of the display unit;

a pair of integrated foot supports generally extending downwardly away from said tray and supporting said tray, said foot supports comprising a generally box-like structures having first and second opposing side planar surfaces each of which are uninterrupted, continuous, integral with and generally coplanar with one of the opposing sidewalls of the display unit, the foot supports defining a pallet aperture therebetween for receiving a loading finger.

3. The display unit of claim 2 wherein the inner and outer portions of the front wall have respective first and second vertical dimensions, the first vertical dimensions being sufficiently small so as to permit viewing of goods placed on the diplay tray from a position outside of the front wall, the second vertical dimension being greater than the first vertical dimension such that a portion of the front wall extends vertically downwardly from the display tray.

4. A display unit for receiving and displaying products, the display unit being assemblable from a primary blank of a foldable sheet material and comprising:

a generally rectangular display tray having a front edge, back edge and two opposing side edges, the display tray having a generally horizontal orientation upon assembly of the display unit so as to accommodate, display and receive goods:

a front wall positioned generally adjacent to the front edge of the display tray and having a generally vertical orientation upon assembly of the display unit;

a pair of opposing sidewalls comprising respective sidewall-forming panels hingedly connected and folded relative to the front wall, each of the sidewalls being positioned generally adjacent to one of the opposing side edges of the display unit and having a generally vertical orientation upon assembly of the display unit;

a backwall positioned generally adjacent to the back edge of the display tray and having a generally vertical orientation upon assembly of the display unit, the backwall comprising a backwall panel hingedly connected and folded relative to one of the sidewall-forming panels and attached to another of the sidewall-forming panels wherein upon assembly, the opposing sidewalls include respective peripheral edges extending angularly upwardly from the front wall toward a plane defined by the back wall; and a pair of integrated foot supports generally extending downwardly away from said tray and supporting said tray, said foot supports comprising a generally box-like structures having first and second opposing side planar surfaces each of which are uninterrupted, continuous, integral with and generally coplanar with one of the opposing sidewalls of the display unit, the foot supports defining a pallet aperture therebetween for receiving a loading finger.

5. The display unit of claim 4 wherein the peripheral edges are oriented at an angle of about 60 degrees relative to a plane of the display tray.

6. A display unit for receiving and displaying products, the display unit being assemblable from a primary blank of a foldable sheet material and comprising:

a generally rectangular display tray having a front edge, back edge and two opposing side edges, the display tray having a generally horizontal orientation upon assembly of the display unit so as to accommodate, display and receive goods;

a front wall positioned generally adjacent to the front edge of the display tray and having a generally vertical orientation upon assembly of the display unit;

a pair of opposing sidewalls comprising respective sidewall-forming panels hingedly connected and folded relative to the front wall, each of the sidewalls being positioned generally adjacent to one of the opposing side edges of the display unit and having a generally vertical orientation upon assembly of the display unit;

a backwall positioned generally adjacent to the back edge of the display tray and having a generally vertical orientation upon assembly of the display unit, the backwall comprising a backwall panel hingedly connected and folded relative to one of the sidewall-forming panels and attached to another of the sidewall-forming panels, wherein upon assembly, the opposing sidewalls each include first and second peripheral edges, the first peripheral edges extending at a first angle upwardly from the front wall a fractional distance toward a plane defined by the back wall, the second peripheral edges extending at a second angle from the first peripheral edge and terminating at the back wall; and a pair of integrated foot supports generally extending downwardly away from said tray and supporting said tray, said foot supports comprising a generally box-like structures having first and second opposing side planar surfaces each of which are uninterrupted, continuous, integral with and generally coplanar with one of the opposing sidewalls of the display unit, the foot supports defining a pallet aperture therebetween for receiving a loading finger.

7. The display unit of claim 6 wherein the first angle is about 60 degrees and the second angle is about 0 degrees relative to a plane of the display tray.

8. A display unit for receiving and displaying products, the display unit being assemblable from a primary blank of a foldable sheet material and comprising:

a generally rectangular display tray having a front edge, back edge and two opposing side edges, the display tray having a generally horizontal orientation upon assembly of the display unit so as to accommodate, display and receive goods;

a front wall positioned generally adjacent to the front edge of the display tray and having a generally vertical orientation upon assembly of the display unit;

a pair of opposing sidewalls comprising respective sidewall-forming panels hingedly connected and folded relative to the front wall, each of the sidewalls being positioned generally adjacent to one of the opposing side edges of the display unit and having a generally vertical orientation upon assembly of the display unit, wherein the outer portion of the front wall has a vertical dimension greater than that of the inner portion of the front wall such that upon assembly of the display unit, a portion of the front wall extends vertically downwardly from the display tray and such that a portion of each of the opposing sidewalls extends vertically downwardly from the display tray;

a backwall positioned generally adjacent to the back edge of the display tray and having a generally vertical orientation upon assembly of the display unit, the backwall comprising a backwall panel hingedly connected and folded relative to one of the sidewall-forming panels and attached to another of the sidewall-forming panels; and a pair of integrated foot supports generally extending downwardly away from said tray and supporting said tray, said foot supports comprising a generally box-like structures having first and second opposing side planar surfaces each of which are uninterrupted, continuous, integral with and generally coplanar with one of the opposing sidewalls of the display unit, the foot supports defining a pallet aperture therebetween for receiving a loading finger.

9. A display unit for receiving and displaying products, the display unit being assemblable from a primary blank of a foldable sheet material and comprising:

a generally rectangular display tray having a front edge, back edge and two opposing side edges, the display tray having a generally horizontal orientation upon assembly of the display unit so as to accommodate, display and receive goods;

a front wall positioned generally adjacent to the front edge of the display tray and having a generally vertical orientation upon assembly of the display unit;

a pair of opposing sidewalls each positioned generally adjacent to one of the opposing side edges of the display unit and having a generally vertical orientation upon assembly of the display unit;

a backwall positioned generally adjacent to the back edge of the display tray and having a generally vertical orientation upon assembly of the display unit, wherein upon assembly, the opposing sidewalls include respective peripheral edges extending angularly upwardly from the front wall toward a plane defined by the back wall;

a pair of integrated foot supports generally extending downwardly away from said tray and supporting said tray, said foot supports comprising a generally box-like structures having first and second opposing side planar surfaces, the first side planar surface being uninterrupted, continuous, integral with and generally coplanar with the front wall of the display unit, the second side planar surface being uninterrupted, continuous, integral with and generally coplanar with the back wall of the display unit, the foot supports defining a pallet aperture therebetween for receiving a loading finger.

10. The display unit of claim 9 wherein the peripheral edges are oriented at an angle of about 60 degrees relative to a plane of the display tray.

11. A display unit for receiving and displaying products, the display unit being assemblable from a primary blank of a foldable sheet material and comprising:

a generally rectangular display tray having a front edge, back edge and two opposing side edges, the display tray having a generally horizontal orientation upon assembly of the display unit so as to accommodate, display and receive goods;

a front wall positioned generally adjacent to the front edge of the display tray and having a generally vertical orientation upon assembly of the display unit;

a pair of opposing sidewalls each positioned generally adjacent to one of the opposing side edges of the display unit and having a generally vertical orientation upon assembly of the display unit;

a backwall positioned generally adjacent to the back edge of the display tray and having a generally vertical orientation upon assembly of the display unit, wherein upon assembly, the opposing sidewalls each include first and second peripheral edges, the first peripheral edges extending at a first angle upwardly from the front wall a fractional distance toward a plane defined by the back wall, the second peripheral edges extending at a second angle from the first peripheral edge and terminating at the back wall;

a pair of integrated foot supports generally extending downwardly away from said tray and supporting said tray, said foot supports comprising a generally box-like structures having first and second opposing side planar surfaces, the first side planar surface being uninterrupted, continuous, integral with and generally coplanar with the front wall of the display unit, the second side planar surface being uninterrupted, continuous, integral with and generally coplanar with the back wall of the display unit, the foot supports defining a pallet aperture therebetween for receiving a loading finger.

12. The display unit of claim 11 wherein the first angle is about 60 degrees and the second angle is about 0 degrees relative to a plane of the display tray.

* * * * *